US005630347A

United States Patent [19]

Elvio

[11] Patent Number: 5,630,347

[45] Date of Patent: May 20, 1997

[54] PHARMACEUTICAL DISPENSER FOR DISPENSING A VARIABLE AND PREDETERMINED NUMBER OF TABLETS OR SIMILAR PRODUCTS PACKAGED IN A BLISTER BAND

[75] Inventor: Gasperini Elvio, Via Mareoiji, Italy

[73] Assignee: I.M.A. Industria Macchine Automatiche S.P.A., Ozzano Emilia, Italy

[21] Appl. No.: 564,603

[22] Filed: Nov. 29, 1995

[30] Foreign Application Priority Data

Dec. 5, 1994 [IT] Italy ..... BO94A0535

[51] Int. Cl.[6] ..... B26D 5/24

[52] U.S. Cl. ..... 83/210; 74/665 GE; 74/810.1; 83/233; 83/367; 83/588; 83/629; 83/649

[58] Field of Search ..... 83/367, 370, 369, 83/208, 210, 629, 371, 221, 231, 233, 588, 649; 74/665 GE, 810.1

[56] References Cited

U.S. PATENT DOCUMENTS

| | | | |
|---|---|---|---|
| 3,903,773 | 9/1975 | Furukawa | 83/208 |
| 3,933,069 | 1/1976 | Tall et al. | 83/367 |
| 3,984,030 | 10/1976 | Morini | 83/151 |
| 4,437,369 | 3/1984 | Brocklehurst et al. | 83/367 |
| 4,737,904 | 4/1988 | Ominato | 83/369 |
| 5,241,884 | 9/1993 | Smithe et al. | 83/369 |

*Primary Examiner*—Rinaldi I. Rada
*Assistant Examiner*—Sean A. Pryor
*Attorney, Agent, or Firm*—McAulay Fisher Nissen Goldberg & Kiel, LLP

[57] ABSTRACT

The device includes dispensing units, each of which features a pair of counter-rotating rollers, between which there is inserted the end of a blister band unrolling from a reel and pushed toward a delivery opening. A blade moves vertically and cooperates with the edge of a support surface, situated downstream of the two rollers, to cut the blister band after a predetermined number of products, counted by a sensor, have passed through the delivery opening. An electric motor drives two ratchet coupling mechanisms acting in opposite directions and connected, by belts or chains, with pulleys or toothed wheels which are integral respectively with the rollers and with a pinion meshing with a rack fastened to the blade. An electronic unit controls and checks the working of the device. Optionally, a token, or coin receiver, a banknote reader or other payment mechanism may be used to allow the user to activate the dispenser after making a payment.

13 Claims, 2 Drawing Sheets

PHARMACEUTICAL DISPENSER FOR DISPENSING A VARIABLE AND PREDETERMINED NUMBER OF TABLETS OR SIMILAR PRODUCTS PACKAGED IN A BLISTER BAND

BACKGROUND OF THE INVENTION

The present invention relates to a dispenser for dispensing a variable and predetermined number of pharmaceutical products like tablets, pills, capsules, etc. housed in a blister pack-like band.

DESCRIPTION OF THE PRIOR ART

It is known that medications like tablets, pills, capsules, etc. housed in a blister package or packages, are kept and sold in suitable boxes or cases.

In other cases, the above mentioned medications (not housed in a blister pack), are kept in bulk in suitable containers and are sold loose, in quantities prescribed every time by a doctor or according to the necessity.

This way of selling is particularly used in some Countries.

Generally, the pharmaceutical products that are sold loose, are kept in suitable containers, like a jar of glass, and are taken out therefrom when it is requested.

In fact, this solution presents many drawbacks, especially of the hygienic kind.

On one hand, these products must be counted, weighed and packaged to be sold, therefore they go through different environments, surely not sterile, touching various utensils like spoons, scales, gloves or similar, and in extreme situations, also the naked hands of the seller.

On the other hand, the products remaining inside the jar of glass, are not protected, even for a relatively long time.

According to another known solution, the pharmaceutical products are packaged in a blister band, large enough to place the products in transversal rows each one including one, two or more of them.

The band is rolled on a reel or folded like a concertina.

This technique has been disclosed in the following publications: DE 33 24 635 A1, DE 28 29 871 A1, DE-GM 18 05 241, DE 42 28 138 A1.

As described in the related art, particularly in the document DE 42 28 138 A1, the blister band, rolled or folded, is inserted into a suitable plastic or cardboard case that is then sold.

Under this condition, packaging techniques for the blister band packages, as well as the traditional case containing one or more blister packs, cannot be used for loose sale.

SUMMARY OF THE INTENTION

The object of the present invention is to propose a device that allows sales of pharmaceutical products packaged in a blister band also in loose sale, with obvious advantages for hygienic conditions of the sold products and aseptically preserving the products not yet sold.

Moreover, another object of the present invention is to propose a device that allows automatic pharmaceutical product sales, according to a desired quantity, making the products available in a simple, rapid and safe way.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT

Figure 1:
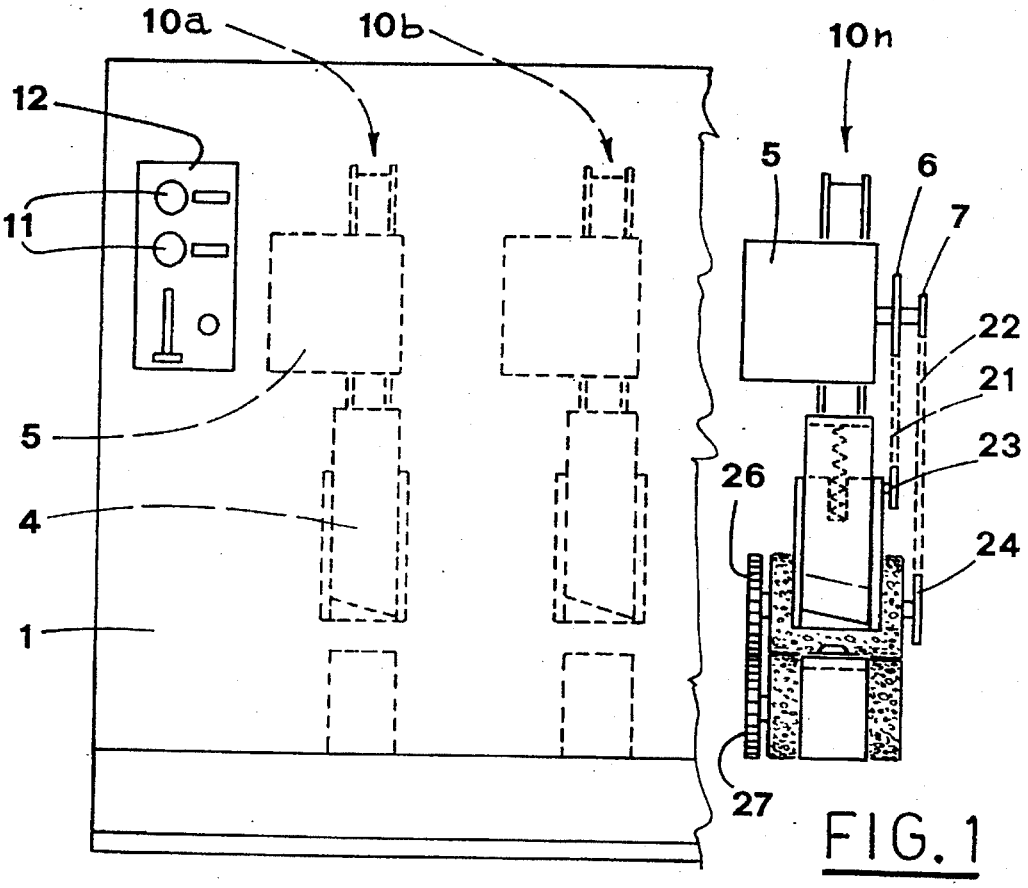
FIG. 1 is a front view of the subject device, with a part of a protective structure broken away for highlighting a working means.
Figure 2:
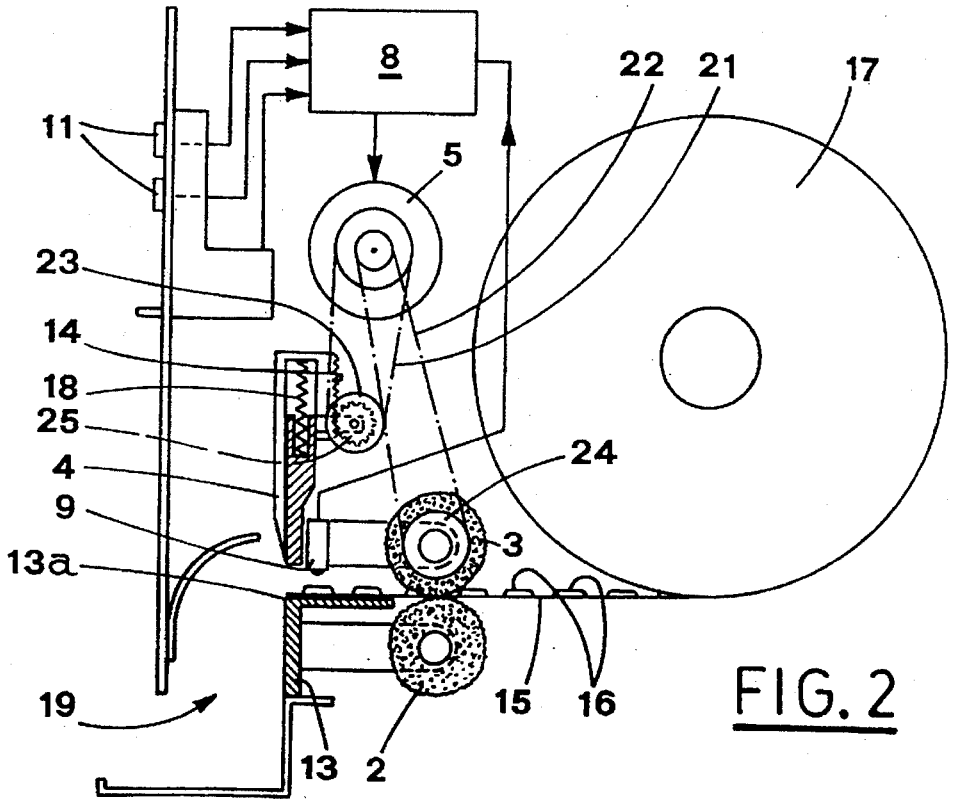
FIG. 2 is a side view of the subject device.

Referring to the Figures, there is illustrated a device that includes n dispensing units $\mathbf{10}_a$, $\mathbf{10}_b$, $\mathbf{10}_n$, e.g. three as shown in the drawings, supported by a panel 1.

The panel 1 may include the front wall of a metal container, not shown, or can be fastened to a wall inserted in a suitable seat made therein.

Each dispensing unit includes means for driving the blister band 15, means for counting the number of products 16 being dispensed, means for cutting the blister band 15 after the predetermined number of the products 16 has been dispensed and after the driving means have been stopped, and means for activating the driving means and cutting means.

The driving means include a pair of rollers 2, 3, with the upper one made of e.g. soft material, counter-rotating and mutually tangential.

The blister band 15, the end of which is inserted between the two rollers, is gradually unrolled from the reel 17 and pushed toward a delivery opening 19.

As an alternative, the blister band can be withdrawn from a suitable container, not shown, inside which it is stored in bulk, or it can be folded in a concertina way or in another way.

Obviously, the rollers can be shaped in other, not shown, ways, i.e. a lower roller can be as large as the blister band and an upper roller may include two or more small wheels that press on the zones without the products, e.g. along the longitudinal edges.

It is also possible to use one roller featuring recesses or cavities that fit the blisters made in the band for the products.

The rollers 2,3 are mutually meshed by means of toothed wheels 26,27 that are integral with respective heads of the rollers.

A supporting surface 13 is situated right downstream of the rollers 2,3, so as to support the gradually unrolled blister band.

The cutting means include a blade 4, moving vertically against an elastic reaction of a spring 18 that pushes it upwards towards the rest position.

The blade 4 is placed between the delivery opening 19 and the rollers 2, 3 and adjacent to the latters.

When the blade 4 is moved downwards, its edge skims the front edge 13*a* of the support surface 13, thus cutting away a section of the blister band that extends over this edge 13*a* toward the delivery opening 19.

A rack 14, arranged vertically, is integral with the blade 4.

Motor means include an electric motor 5, e.g. step motor, that drives two one-way rotary mechanisms 6,7, also known as ratchet couplings, which act in opposite directions with respect to each other.

One of the mechanisms, e.g. the mechanism 7 that transmits clockwise rotation, is connected, by a chain or belt 22, to a pulley or toothed wheel 24, integral with one of the two driving rollers 2, 3.

The other mechanism 6, that transmits counterclockwise rotation, is connected, by a chain or belt 21, to a pulley or toothed wheel 23 combined with a pinion 25 that engages the rack 14, integral with the blade 4.

The means for counting the number of products 16 being dispensed include a sensor 9, of known type, aimed at detecting each product passing nearby.

The sensor 9 is suitably situated, e.g. over the support surface 13, so as to be near the side of the blister band 15 that carries the products 16 to be delivered.

It is obvious that the counting sensor 9 can be situated also in other positions, like upstream of the rollers 2,3.

The control and check means are formed by an electronic unit 8 connected with the motor 5 in order to determine its clockwise or counterclockwise rotation, with the counting sensor 9 and with operating means 11 that include push buttons.

The panel 1 supports the push buttons 11 that can be operated from outside, and that are designed to activate selection of the product to be dispensed, to predetermine the quantity of the product 16 to be dispensed and/or other supplementary operations usually performed by the known dispensers.

The device in its main embodiment as described heretofore, can be installed in licensed retail shops, e.g. drugstores, where it is used only by the selling staff.

In another embodiment, the device can be equipped with further on-off means, like a coin or token receiver and/or banknote reader or other payment devices. The device in this last embodiment can be installed in a place where it is within everybody's reach.

The device operation is simple and easy to understand. After receiving the order, the retailer selects, using the push buttons 11, the kind of product, i.e. the dispensing unit that is to be operated, and the desired quantity of product to be delivered.

If the device is made accessible to everyone, before selecting the product and determining its quantity, or after having performed these operations, the user must activate the dispenser by inserting coins, tokens, or other payment means into a token receiver or in a banknote reader 12.

The unit 8 operates the motor 5 of the selected dispensing unit, so that it rotates in clockwise direction, and the ratchet mechanism 7 transmits the movement to the driving rollers 2, 3 by means of the belt 22 and the pulley 24.

Figure 3:
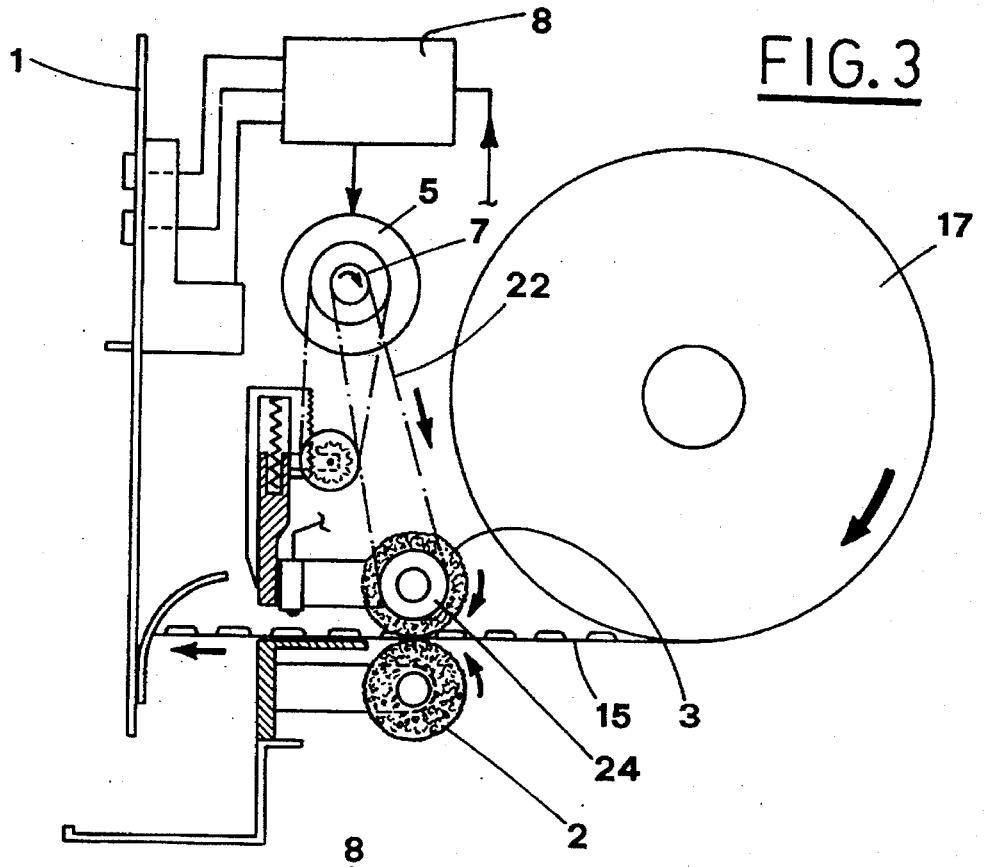
FIGS. 3 and 4 are side views of the device in two characteristic working stages.

In the meantime, the mechanism 6 is idle (FIG. 3). The dispensing unit rotates until the counting sensor 9 has detected a predetermined number of products 16 and has sent a suitable signal to the control unit.

At this point, the motor 5 rotates in counterclockwise direction, therefore the ratchet coupling 6 transmits rotation to the pinion 25 connected to the rack 14 of the blade 4 that consequently lowers and cuts the blister band 15.

Figure 4:
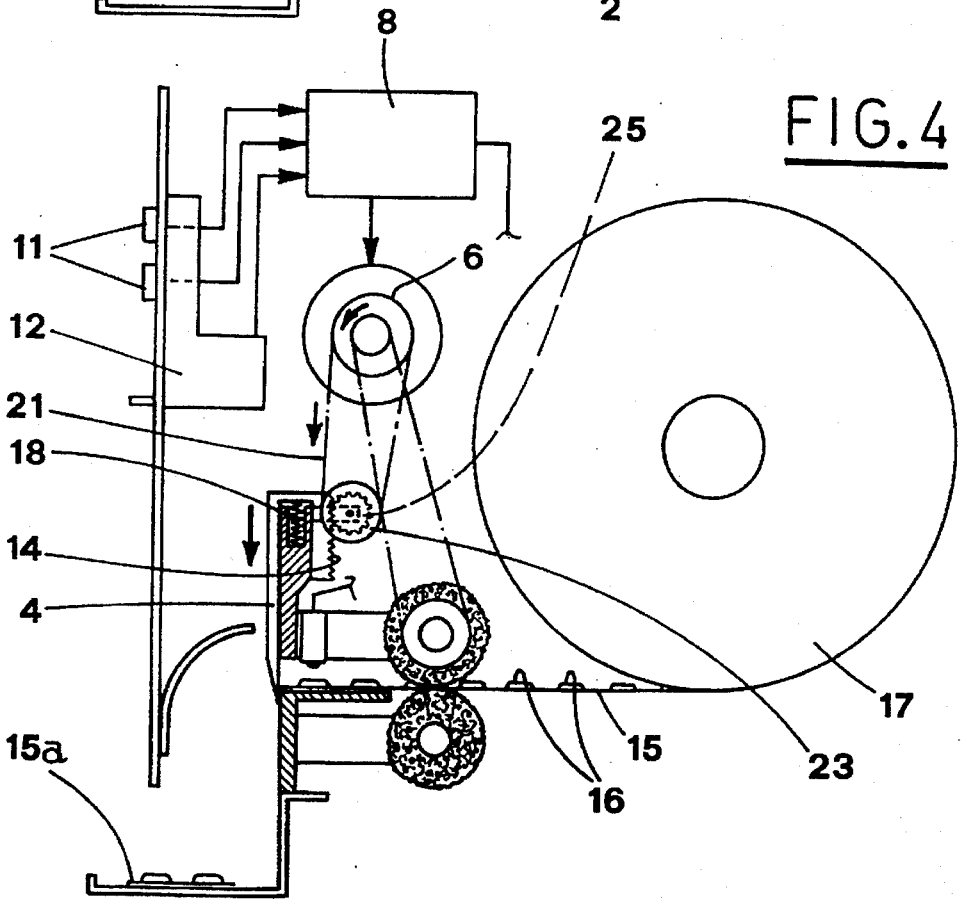

In the meanwhile, the mechanism 7 is idle and the rollers 2,3 remain motionless (FIG. 4).

When the blister band has been cut, the return spring 14 gets ready to bring the blade back to the raised position, while the cut off part 15*a* of the blister band 15 passes through the delivery opening 19 and falls into a suitable holder that is accessible for the user outside.

The elastic reaction of the return spring 18 brings the blade 4 back to its rest position when the motor 5 is started up again so as to move the blister band 15 again.

In this connection, it is to be pointed out that the transmission rate from mechanisms 6,7 to the respective pulleys or toothed wheels are such, that a minimum rotation of the motor 5 in order to activate the rollers 2, 3 corresponds to a wide movement upwards of the blade 4.

Otherwise, it is possible to provide linking means, of known kind, between the pinion 25 and the connected pulley or toothed wheel, such that they release one from the other when the blade 4 must move upwards.

The number of dispensing units can be different from the illustrated one, and the device may have only one dispensing unit, or more than three units.

It is evident that the above described invention achieves its objects by proposing a simple and versatile dispenser.

The pharmaceutical products dispensed by the present device never contact environments or things that could damage their conservation in the protected environment, that results in better hygiene and conservation conditions and the possibility to sell a variable number of products, according to the doctor's specific indications or the user's needs.

All this has another, economic advantage, resulting from the reduction of the wastes of dispensed products, as products are bought and used in only needed quantities.

Yet further advantage, resulting from the previous one, consists in diminishing disposal of the used materials.

Finally, it is to be pointed out that no containers like cases or boxes are used, that results in evident advantages.

It is understood that what above has been described is a mere, not limitative example, therefore all possible constructive variants are protected by the present technical solution, as described above and claimed in the following.

What is claimed is:

1. A dispenser for a variable and predetermined number of tablets or similar products packaged in a blister band, the blister band rolled longitudinally so as to form a reel, the dispenser having at least one dispensing unit comprising:

means for driving the blister band so that the blister band is gradually unrolled from the reel and pushed toward a delivery opening;

means for checking the number of dispensed products in accordance with a predetermined number of products;

means for cutting the blister band, operated after the predetermined number of the products has been counted and after the driving means have been stopped;

means for operating the driving means and cutting means;

said operating means being an electric motor, a first ratchet one-way rotation transmission mechanism and a second ratchet one-way rotation transmission mechanism, each driven by the electric motor, a first belt means linking the first mechanism to a first wheel means, integral with said driving means, a second belt means linking the second mechanism, to a second wheel means, combined with a pinion that engages the cutting means.

2. Dispenser according to claim 1 wherein the first belt means is selected from the group consisting essentially of a chain and a belt.

3. Dispenser according to claim 1, wherein said driving means include a pair of counter-rotating and mutually tangential rollers between which an end of the blister band is inserted, the rollers being in mutual engagement by means of toothed wheels integral with respective heads of said rollers.

4. Dispenser according to claim 1, wherein said cutting means include a blade, moving against the reaction of an elastic means that push the blade upwards to a rest position, the blade cooperating with an edge of a support surface which supports the blister band while the blister band is being unrolled.

5. Dispenser according to claim 1, wherein a rack is made integral with said means for cutting and meshes with said pinion integral with said second wheel means.

6. Dispenser according to claim 1, wherein said means for checking the number of products being dispensed include a sensor that detects each product passing nearby.

7. Dispenser according to claim 1, wherein means are provided for controlling and checking the operating means, said controlling and checking means being also connected with on/off means, with means for predetermining the quantity of products being dispensed, and with means for checking the number of products being dispensed.

8. Dispenser according to claim 7, wherein said controlling and checking means include an electronic unit.

9. Dispenser according to claim 7, wherein said on/off means include payment means for accepting payment prior to activating the on/off means.

10. Dispenser according to claim 4, wherein a rack is made integral with said blade and meshes with said pinion integral with said second wheel means.

11. Dispenser according to claim 1 wherein the second belt means is selected from the group consisting of a chain and a belt.

12. Dispenser according to claim 1 wherein the second wheel means is selected from the group consisting of a pulley and a toothed wheel.

13. Dispenser according to claim 1 wherein the first wheel means is selected from the group consisting of a pulley and a toothed wheel.

* * * * *